US005607086A

United States Patent [19]

Gooch

[11] Patent Number: 5,607,086

[45] Date of Patent: Mar. 4, 1997

[54] CONTAINER ASSEMBLY WITH MOVABLE SPOUT

[76] Inventor: Joel S. Gooch, 264 E. Summit Ave., San Antonio, Tex. 78212

[21] Appl. No.: 447,912

[22] Filed: May 23, 1995

[51] Int. Cl.[6] ..... B67D 5/06

[52] U.S. Cl. ..... 222/525; 222/530

[58] Field of Search ..... 222/523, 525, 222/530, 538

[56] References Cited

U.S. PATENT DOCUMENTS

| | | | |
|---|---|---|---|
| 1,877,226 | 9/1932 | Chamberlain | 222/525 X |
| 3,172,573 | 3/1965 | Parish, Jr. et al. | 222/525 X |
| 3,372,846 | 3/1968 | Berkus | 222/538 X |
| 4,311,259 | 1/1982 | Babiol | 222/525 |
| 4,650,096 | 3/1987 | Thatcher | 222/525 X |
| 5,230,442 | 7/1993 | Dean, Jr. | 222/571 X |

*Primary Examiner*—Andres Kashnikow
*Assistant Examiner*—Kenneth Bomberg
*Attorney, Agent, or Firm*—Patterson & Streets, L.L.P.

[57] ABSTRACT

A container spout assembly including a neck member and a spout member is shown. The spout member is recessed into the container and held in the neck member by a flange. On extension an in-turned cuff on the neck member forms a space into which extends an out-turned cuff member of the spout member. The spout member is held in place so that a fluid can be poured from the container with the benefit of the spout member. The spout member can also be retracted if the container is to be used more than once.

19 Claims, 3 Drawing Sheets

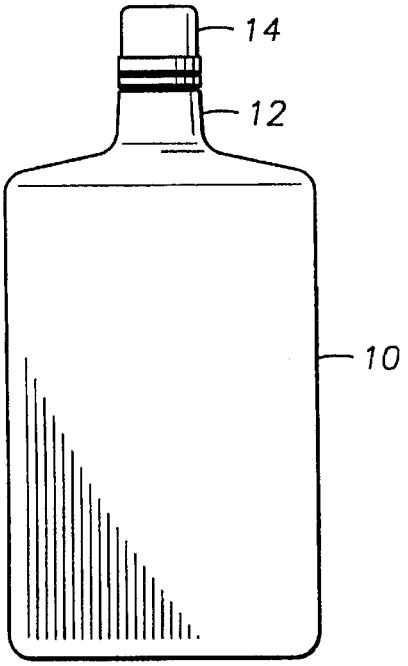
FIG. 1
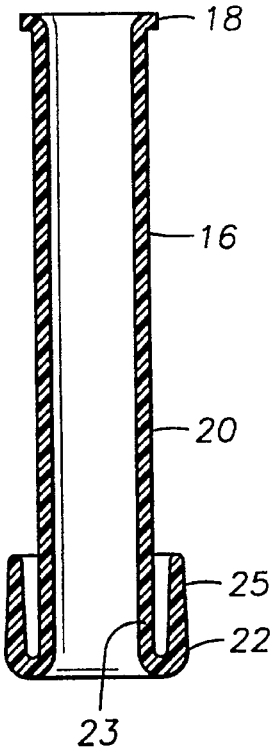
FIG. 3
FIG. 2
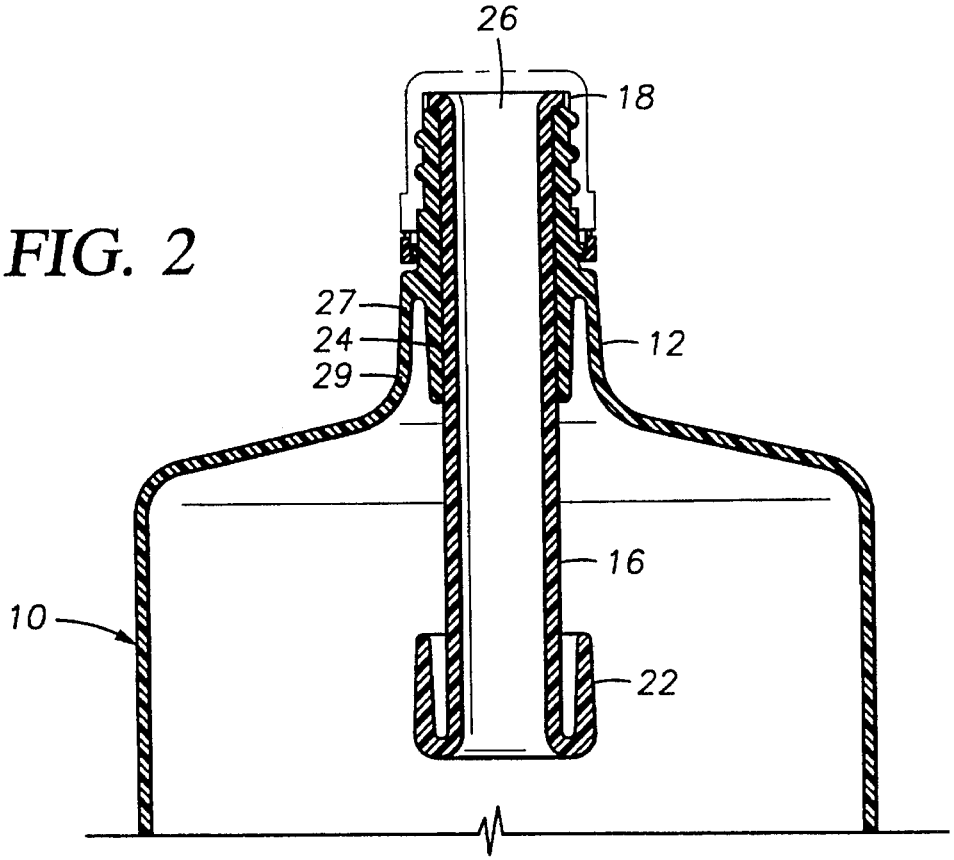

CONTAINER ASSEMBLY WITH MOVABLE SPOUT

FIELD OF THE INVENTION

The present invention relates to a container spout assembly. More specifically, the present invention relates to a container spout assembly having a movably extendible and retractable spout for delivery of a fluid contained in the container. The container and spout are cooperatively connected to function as a single unit in the delivery of fluids.

BACKGROUND OF THE INVENTION

In general, there are various containers which are known to dispense fluids. Specifically, U.S. Pat. Nos. 4,650,096 and 5,230,442 disclose containers having spouts which are used to dispense fluids.

There exists a need for a container spout assembly which improves upon the prior art and provides for a spout and container assembly adaptable for use with the containers employed by today's manufacturers. The container and spout assembly of the present invention provides a container spout assembly that is easy to use and is easily incorporated into the design of existing containers. In addition, the present invention provides a low cost container and spout assembly that is easily filled during the production process.

SUMMARY OF THE INVENTION

The present invention relates to a container spout assembly having a neck member wherein a spout is movably housed to extend into a coupled position free to rotate through 360° or retract to enable closure of the container cap. The neck member is folded inwardly to form an in-turned cuff. The lower portion of the spout is folded outwardly to provide an out-turned cuff which corresponds to the in-turned cuff of the neck member. The in-turned cuffs and out-turned cuffs are adapted to be coupled when the spout member is in the extended position.

The in-turned and out-turned cuffs of the present invention are also envisioned to be adapted with protrusions and recesses which cooperate with one another to secure the spout member in a retracted position.

DESCRIPTION OF THE DRAWINGS

FIG. 1 is a side view of a container which can be adapted with the present invention;

FIG. 2 is a side view of spout assembly showing the neck portion of a container and the spout with its out-turned cuff;

FIG. 3 is a side view of the spout member showing the flange at its upper end;

DETAILED DESCRIPTION OF THE PREFERRED EMBODIMENT

Figure 4:
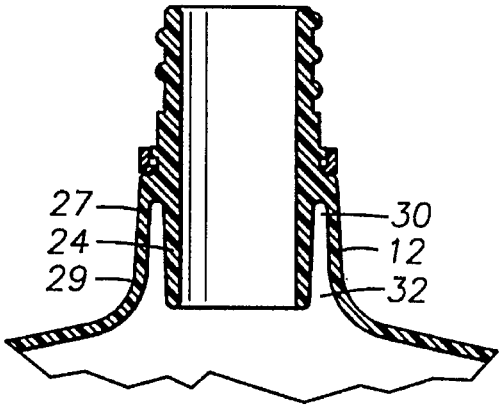
FIG. 4 is a side view showing the in-turned cuff of the neck member.

Referring now to the drawings, FIG. 1 generally shows a container 10. The container 10 has a neck member 12 extending from the top portion of the container 10. The neck member 12 is adapted to receive a cap member 14. Preferably, the neck member 12 is threaded to receive a female threaded cap member 14. The container 10 is and may be available in many shapes, i.e., a cylindrical container, a rectangular container, a square container, or any other shaped container. In any event, the shape of the container is not limiting of the present invention. Presently, the container 10 shown in the drawings generally reflects the current shape of oil containers used by many of the commercial oil companies. The container may be made of any suitable material which is able to contain a fluid. As examples, and in no way limiting, the container may be made of plastic, aluminum, or other suitable polymer or metal.

Referring now to FIG. 2, a side view of the neck member 12 is shown wherein the spout member 16 is slidably housed within the neck member 12. The spout member 16 is preferably an arcuate, cylindrical member which defines a passage therethrough to allow flow of a fluid. The spout member 16 may be of any shape, however. The spout member 16 is sized to slidably reciprocate in the neck member 12. The spout member 16 has a flange 18 on its upper end to prevent the spout member 16 from extending into the container 10. FIG. 3 shows a side view of the spout member 16 and the flange 18. The lower portion of the spout member 20 has an out-turned cuffed 22. The out-turned cuff 22 has inner wall 23 and outer wall 25. The outer wall 25 may parallel the inner wall 23 or be slightly angled relative to the inner wall 23. The upper portion of the neck member 27 (FIG. 2) has an in-turned cuff 24. On extension, the out-turned cuff 22 slides along the wall 29 of the neck member 12 of the container and into a space formed between the wall 29 and the in-turned cuff 24. The respective cuffs are sized to achieve a tight fit on extension of the spout member 16 into the retracted position. The flange 18 allows the spout member 16 to be retracted to a flush position with respect to the spout member 16 and the mouth 26 of the container.

FIG. 4 shows a side view of the neck member 12. The wall of the neck member 29 is folded inwardly to form the in-turned cuff 24. The in-turned cuff 24 defines a space between the in-turned cuff 24 and the wall 29 of the container 10. The in-turned cuff 24 may parallel the wall 29 of the container 10 or it may be angled relative to the wall 29. The space between the in-turned cuff 24 and the wall 29 is generally angled from an wider mouth 32 to a narrower trough 30. In another embodiment, the in-turned cuff 24 may have a protrusion extending into the space formed between the wall 29 and the in-turned cuff 24 to lock the out-turned cuff 22 therein.

The neck member 12 is formed as to be free of the top wall and of a certain diameter. In reference to the neck, an in-turned cuff is formed at the annular free end of the neck portion of the container. The in-turned cuff 24 is of a lesser diameter than the neck member 12 and extends down into the neck member 12 a determined distance and forms a bottom opening exposed to the inside of the container 10. The cylindrically in-turned cuff 24 at the annular free end of the neck member 12 may be any length from top to bottom. Typically, the in-turned cuff 24 is in the range of ¼ to ½ inch in length. Thus, there is a workable space 30,32 created between the wall 29 and the in-turned cuff 24. The distance between the wall 29 and the cylindrical in-turned cuff 24 is of a determined distance to allow coupling with the out-turned cuff 22 of the spout member 16. The cylindrical spout 16 being made of a plastic material is of a diameter lesser than the cylindrical in-turned cuff 24 and has an annular free opening which comprises a flange 18 of a larger diameter than the mouth 26 of the neck member 12. This flange 18 is provided to hold the spout member 16 effectively in a retracted position internally within the container 10, in which the flange 18 rests upon the top neck section. The lower portion of the spout member 20 opens into the inside of the container 10. From the opening, a cylindrical out-turned cuff 22 surrounds the lower portion of the spout member 20 and traverses up some distance along the spout contours. Thus, the out-turned cuff 22 surrounds the lower portion of the spout member 16 up some distance. The cylindrical out-turned cuff 22 is of a diameter lesser than the wall 29, but greater than the in-turned cuff 24. This cylindrical out-turned cuff 22 may taper from a larger gap 32 to a narrower trough 30. Hence, as the spout is moved from the retracted position to an extended position by grasping the flange portion of the top section at the annular free end of the neck and pulling the spout to the extended position, the bottom portion of the collar at the lower section of the spout slides into the in-turned cuff 24 at the annular free end of the neck portion until it is fully extended. Therefore, the out-turned cuff is able to wedge into the space formed between the wall 29 and in-turned cuff 24 creating enough tension to hold the extended spout member 16 in place to assist in the dispensing of fluids in a useful manner. Thus, the manner in which fluid is dispensed is effectively accomplished without allowing any fluid to spill onto the user or the surrounding area which in turn prevents fluid loss and soiling.

The spout assembly may be manufactured by extrusion methods, blow molding, injection mold molding methods, or by any other method suitable for manufacturing plastic products. In any event, the manufacturing process is not limited to a specific process, method or system. It is envisioned that the cuffs will be formed by folding an extended portion of the neck member 12 and the spout member 16 with a press. The extensions, once folded, become or function as cuff members.

Figure 5:
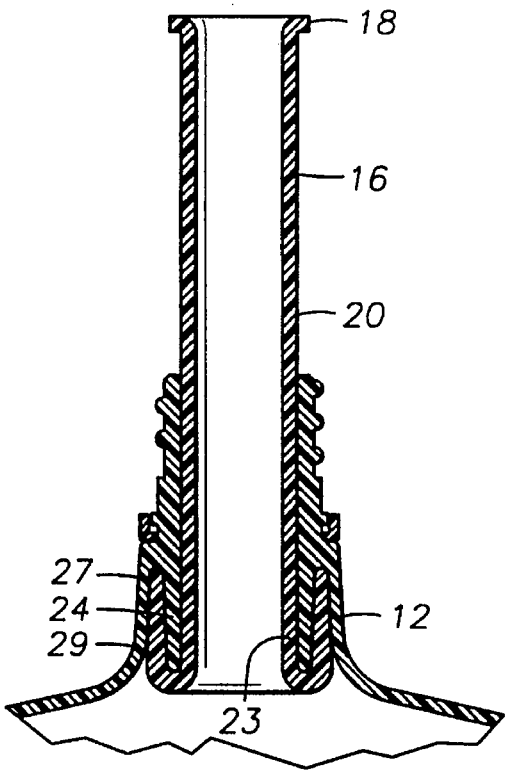
FIG. 5 is a side view of the neck member wherein the spout member is shown in an extended and coupled position.

FIG. 5 shows a side view of the neck member 12 wherein the spout member 16 is shown extended within the neck member 12. The spout member 16 is sized to slidably reciprocate within the aperture of the neck member 12 formed by the in-turned cuff 24. The in-turned cuff 24 is adapted to exert pressure on the spout member 16 while in a relaxed state. In other words, the spout member 16 fits tightly into the opening defined by the in-turned cuff 24.

Figure 6:
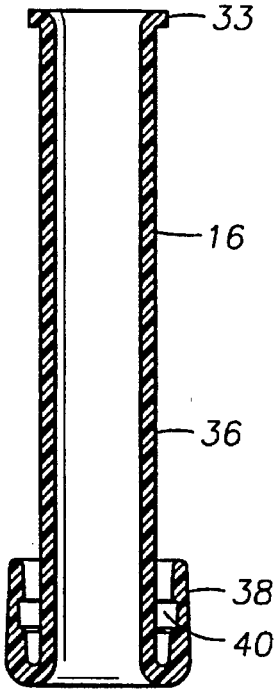
FIG. 6 is a side view of the spout member with the out-turned cuff having a cylindrical groove therein.

FIG. 6 shows a side view of the spout member 36. The spout member 39 has a flange 33 on its upper end to prevent the spout member 36 from extending into the container 10'. The lower end of the spout member 36 has an out-turned cuff 38. The out-turned cuff 38 has a cylindrical groove 40 therein. The groove 40 is adapted to receive a notch or protrusion on the in-turned cuff 44. This additional feature aids in securing the spout member 36 in a fixed position on extension.

Figure 7:
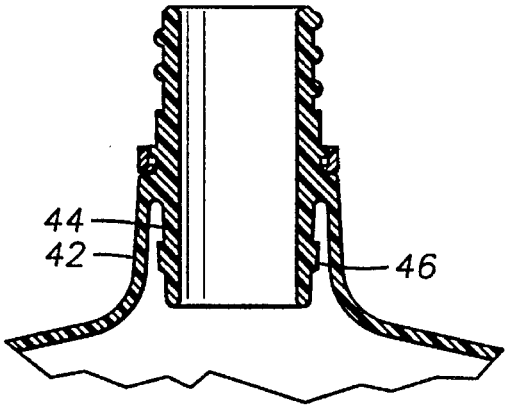
FIG. 7 is a side view of the neck member showing the in-turned cuff having a cylindrical protrusion thereon.

FIG. 7 shows a side view of the wall of the neck member 42. The wall of the neck member is folded inward to form an in-turned cuff 44. The in-turned cuff 44 defines a space between the in-turned cuff 44 and the wall of the neck member 42. The in-turned cuff 44 has a cylindrical protrusion 46 extending into the space formed between the neck member wall 42 and the in-turned cuff 44. On extension of the spout member, the out-turned cuff 38 slides along the wall of the neck member 42 and into a space formed between the neck member wall 42 and the in-turned cuff 44. Thus, allowing the in-turned cuff 44 and the cylindrical protrusion 46 to mate with the in-turned cuff 38 (FIG. 6) and cylindrical groove 40 (FIG. 6). This interconnection allows the spout member 16 (FIG. 6) to be held in an extended position.

Figure 8:
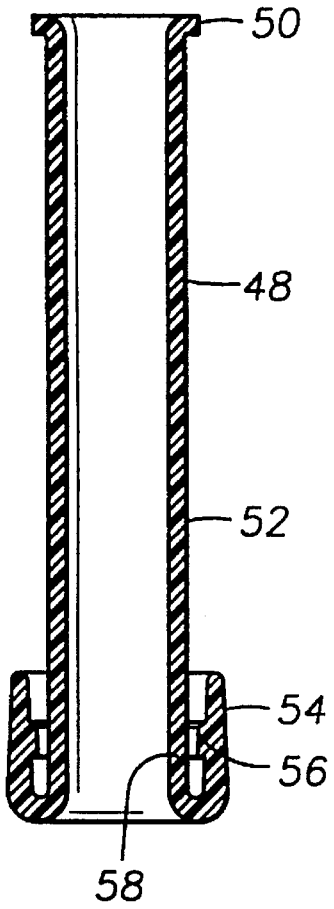
FIG. 8 is a side view of the spout member showing the out-turned cuff having a cylindrical protrusion thereon.

FIG. 8 shows a side view of the spout member 48 and a flange 50 on its upper end. The lower end of the spout member 52 has an out-turned cuff 54 and a cylindrical protrusion 56 which extends into the space between the out-turned cuff 54 and the spout member wall 58.

Figure 9:
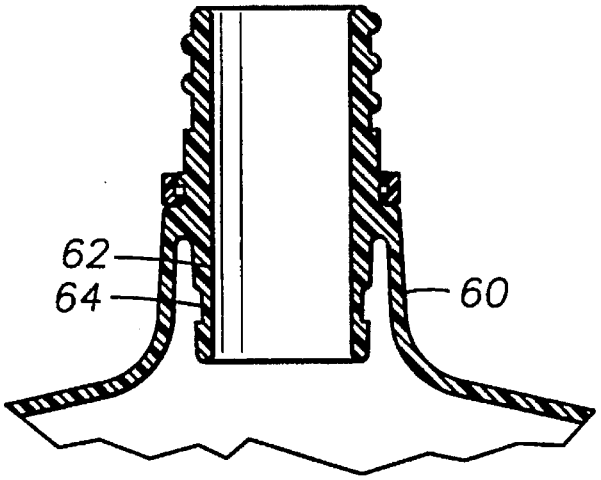
FIG. 9 is a side view of the neck member with an in-turned cuff showing the cylindrical groove therein.

FIG. 9 shows a side view of the neck member 60. The neck member 60 has an in-turned cuff 62 that extends down into the neck member 60. The in-turned cuff 62 has a cylindrical groove 64. 0n extension of the spout member, the out-turned cuff 54 (FIG. 8) slides along the wall of the container and into a space formed between the wall and the in-turned cuff 62. Thus, allowing the in-turned cuff 62 and cylindrical groove 64 to mate with the out-turned cuff 54 (FIG. 8) and the cylindrical protrusion 56 (FIG. 8) and hold the spout member 48 (FIG. 8) in an extended position.

While the above description references a preferred embodiment, the scope thereof is not thereby limited and the claims which follow define the scope of the present invention.

I claim:

1. A container and spout assembly comprising:

a container;

a neck member extending from the container, said neck member having an in-turned cuff which turns back upon a circumferential wall of the neck member; and a spout member movably housed within said neck member, said spout member having an out-turned cuff which turns back upon a circumferential wall of the spout member for coupling with the in-turned cuff.

2. The container and spot assembly of claim 1 wherein the in-turned cuff has a protrusion extending therefrom and the out-turned cuff has a groove formed therein, wherein the protrusion and the groove are adapted to be coupled on extension of the spout member.

3. The container and spout assembly of claim 2 wherein the spout member further includes a flange on an upper portion of the spout member.

4. The container and spout assembly of claim 1 wherein the in-turned cuff is angled relative to the circumferential wall of the neck member.

5. The container and spout assembly of claim 1 wherein the out-turned cuff is angled relative to the circumferential wall of the neck member.

6. The container and spout assembly of claim 1 wherein the in-turned cuff parallels the circumferential wall of the neck member.

7. The container and spout assembly of claim 1 wherein the out-turned cuff parallels the circumferential wall of the neck member.

8. A container and spout assembly, comprising:

a neck member defining a mouth opening into a container, said neck member having an in-turned cuff which turns back upon a circumferential wall of the neck member, said in-turned cuff defining a space between the in-turned cuff and the circumferential wall of the neck member;

a spout member slidably housed in said neck member, said spout member having an out-turned cuff which turns back upon a circumferential wall of the spout member at a lower portion of the spout member and a flange at an upper portion of the spout member;

wherein said out-turned cuff of said spout member is adapted to slide into the space defined by the in-turned cuff and the wall of the neck member on extension of the spout member.

9. The container assembly of claim 8 wherein the in-turned cuff is angled relative to the circumferential wall of the neck member.

10. The container assembly of claim 8 wherein the out-turned cuff is angled relative to the circumferential wall of the neck member.

11. The container and spout assembly of claim 8 wherein the in-turned cuff parallels the circumferential wall of the neck member.

12. The container and spout assembly of claim 8 wherein the out-turned cuff parallels the circumferential wall of the neck member.

13. The container and spout assembly of claim 8 wherein the in-turned cuff includes a protrusion extending into the space defined by the in-turned cuff and the circumferential wall of the neck member, and the out-turned cuff includes a notch wherein said protrusion extends into the notch to hold the spout in the extended position on extension.

14. A spout assembly adapted to aid in the delivery of fluids, the assembly comprising:

a container defining an aperture therein, wherein said aperture includes a neck member having an in-turned cuff which turns back upon a circumferential wall of the neck member extending into the container;

a spout member slidably housed within the aperture, said spout member including an out-turned cuff which turns back upon a circumferential wall of the spout member adapted to couple with the in-turned cuff on the aperture.

15. The spout assembly of claim 14 wherein the in-turned cuff is angled relative to the circumferential wall of the neck member.

16. The spout assembly of claim 14 wherein the out-turned cuff is angled relative to the circumferential wall of the neck member.

17. The spout assembly of claim 14 wherein the in-turned cuff parallels of the circumferential wall of the neck member.

18. The spout assembly of claim 14 wherein the out-turned cuff parallels the circumferential wall of the neck member.

19. The spout assembly of claim 14 wherein the in-turned cuff includes a protrusion extension into a space defined by the in-turned cuff and the circumferential wall of the neck member, and the out-turned cuff includes a notch wherein said protrusion extends into the notch to hold the spout in an extended position on extension.

* * * * *